US012692657B2

(12) United States Patent
Mariani et al.

(10) Patent No.: US 12,692,657 B2
(45) Date of Patent: Jul. 28, 2026

(54) MACHINE FOR PRODUCING CARDBOARD

(71) Applicant: RENOVA S.R.L, Milan (IT)

(72) Inventors: Marco Mariani, Milan (IT); Ugo Re, Milan (IT)

(73) Assignee: RENOVA S.R.L., Milan (IT)

( * ) Notice: Subject to any disclaimer, the term of this patent is extended or adjusted under 35 U.S.C. 154(b) by 599 days.

(21) Appl. No.: 18/326,098

(22) Filed: May 31, 2023

(65) Prior Publication Data

US 2023/0383466 A1 Nov. 30, 2023

(30) Foreign Application Priority Data

May 31, 2022 (IT) ..... 102022000011435

(51) Int. Cl.
*B65H 23/08* (2006.01)
*D21F 7/02* (2006.01)
*D21G 9/00* (2006.01)

(52) U.S. Cl.
CPC ..... *D21G 9/0036* (2013.01); *D21F 7/02* (2013.01)

(58) Field of Classification Search
CPC ..... B65H 23/08; B65H 23/066; B65H 75/30; B65H 75/4436; D21G 9/0036; D21F 7/02
See application file for complete search history.

(56) References Cited

U.S. PATENT DOCUMENTS 5,069,394 A * 12/1991 Panttila ..... D21F 7/02 192/85.49
5,967,445 A * 10/1999 Yuyama ..... B65H 16/04 242/597.6
7,540,447 B2 * 6/2009 Shiraishi ..... B65H 23/06 242/421.7
11,851,298 B2 * 12/2023 Mariani ..... B65H 23/1825
(Continued)

FOREIGN PATENT DOCUMENTS

CN 201932745 U 8/2011
EP 3766813 A1 1/2021
JP 2012206790 A 10/2012

OTHER PUBLICATIONS

Italian Search Report and Written Opinion received for IT Application No. 202200011435, on Feb. 15, 2023, 8 pgs.

*Primary Examiner* — Sang K Kim
(74) *Attorney, Agent, or Firm* — Merchant & Gould P.C.

(57) ABSTRACT

A machine producing multi-layer cardboard/paper includes a system for controlling braking on a braking system including a motor-generator and a pneumatic mechanical brake. The system includes a command/control unit, and a pressure transducer reading air pressure along a line from the machine and translating into an electrical signal. An electro-pneumatic converter adjusts pressure of the air at a delivery pressure and an input connects to an air line at a fixed pressure greater than the delivery pressure, and. An output connects to the mechanical brake at a preset braking torque. A solenoid valve pneumatically connects at the input, to an (Continued)

electro-pneumatic converter output, to the air line at the pressure from the machine, and at the output. The delivery line connects the solenoid valve to the mechanical brake. The command/control unit calculates splitting braking torque between mechanical braking torque and motor-generator braking torque and controls the motor-generator braking torque.

11 Claims, 5 Drawing Sheets

(56) References Cited

U.S. PATENT DOCUMENTS

| | | | | |
|---|---|---|---|---|
| 2007/0170299 | A1* | 7/2007 | Ritter | B65H 23/185 242/533.6 |
| 2017/0267001 | A1* | 9/2017 | Hayashi | B65H 23/1825 |
| 2021/0129198 | A1* | 5/2021 | de Kock | H02K 25/00 |

* cited by examiner

MACHINE FOR PRODUCING CARDBOARD

CROSS-REFERENCE TO RELATED APPLICATIONS

This application claims the benefit of Serial No.: 10 2022 000011435, filed May 31, 2022 in Italy, and of Serial No.: 10 2022 000021198, filed Oct. 14, 2022 in Italy, and which applications are incorporated herein by reference. To the extent appropriate, a claim of priority is made to the above disclosed application.

FIELD OF THE INVENTION

The present invention relates to a machine for producing multi-layer cardboard or paper, or a machine for either the printing or converting field, starting from a reel of paper or other material. In general, the invention can be applied to machines, in which a reel of different materials is unwound, and which requires a contrast system to adjust the tensioning of the ribbon. In particular, the invention relates to a braking system for braking said reel.

BACKGROUND OF THE INVENTION

By way of example, machines for producing multi-layer cardboard, for example, corrugated cardboard, typically comprise systems for unwinding paper from appropriate reels, systems for corrugating the intermediate layer and systems for coupling and gluing the various layers.

The reels of paper used for the different layers are normally large and therefore have a high weight. In order to avoid the uncontrolled unwinding of paper from such reels and to adjust the tensioning thereof correctly, braking systems are thus provided, which can be both mechanical (e.g., caliper brakes) and pneumatic, or of the motor-brake or electromagnetic powder brake type.

The mechanical brake has the drawback of transforming the kinetic energy, through friction, into thermal energy, which is lost by dissipation into the external environment.

The motor-brake has instead the drawback of having large dimensions, being costly, and in the launching and rewinding steps, having high energy consumption, which features are necessary for implementing an adequate braking action for a large reel of paper.

Solutions are known, which combine, on the same axis, a mechanical brake and a motor-brake and which are configured so as to split the braking force on the two braking modes according to the needs. Such solutions optimize the braking action and also lead to a recovery of energy which, in certain circumstances, can be reintroduced into the power supply network, thus resulting in a saving in production costs. A system of this type is known from EP 3766813 A1 to the same Applicant.

Although such a system is efficient and easy to use on several machines for producing cardboard, it cannot however be applied universally. In fact, some types of machines have an integrated control of the braking system characterized by lengthy reaction times upon varying the tensioning of the paper. In practice, in these machines, the braking force is not modified within a wide range of tensioning forces as measured with appropriate sensors. In such types of machines, the system provided in EP 3766813 A1, which requires quick response times, has demonstrated a limited use.

SUMMARY OF THE INVENTION

Therefore, the problem underlying the present invention is the provision of a braking system which reduces energy consumption and dispersion of energy into the environment, which has small dimensions, and which can be integrated universally into machines for unwinding reels already installed.

Such a problem is solved by a braking system for reels as defined in the appended claims, the definitions of which form an integral part of the present description.

In particular, the invention relates to a system for controlling the braking of a machine for producing cardboard or corrugated cardboard, having or in which at least one braking system has been installed, comprising a motor-generator device and a pneumatic mechanical brake device, where said system comprises:

- a command and control unit;
- a pressure transducer configured to read a pressure of the air along a line coming from the machine for producing cardboard and to translate it into an electrical signal to be sent to the command and control unit, where the pressure of the line is optionally calculated by an electro-pneumatic converter of said machine outside said system;
- an electro-pneumatic converter integrated into said system, different from the optional electro-pneumatic converter of said machine, and operatively connected to said command and control unit, the electro-pneumatic converter of the system being configured to adjust the pressure of the air at a delivery pressure and being connected at the input to an airline at a fixed pressure which is greater than the delivery pressure, and at the output, to an output line;
- a user interface operatively connected to the command and control unit;
- optionally, a solenoid valve pneumatically connected: i) at the input, to said output line of the electro-pneumatic converter and to a derivation of the air line at the pressure coming from the machine for producing cardboard, and ii) at the output, to a delivery line for delivering air at a braking pressure, where said delivery line connects the solenoid valve to a mechanical brake device and where said braking pressure is equal to the pressure Pm of the machine when the system is in the deactivated state or, when the system is in the activated state, to said delivery pressure;
- where said command and control unit calculates a splitting of the preset braking torque CL to be supplied between a braking torque CF of the mechanical brake device and a braking torque CM of a motor-generator device according to the pressure detected by the pressure transducer and it commands the braking torque CM of the motor-generator device according to said calculation.

Further features and advantages of the present invention will become more apparent from the description of some embodiments thereof, given below by way of non-limiting indication, with reference to the annexed figures.

DETAILED DESCRIPTION OF THE INVENTION

Figure 1:
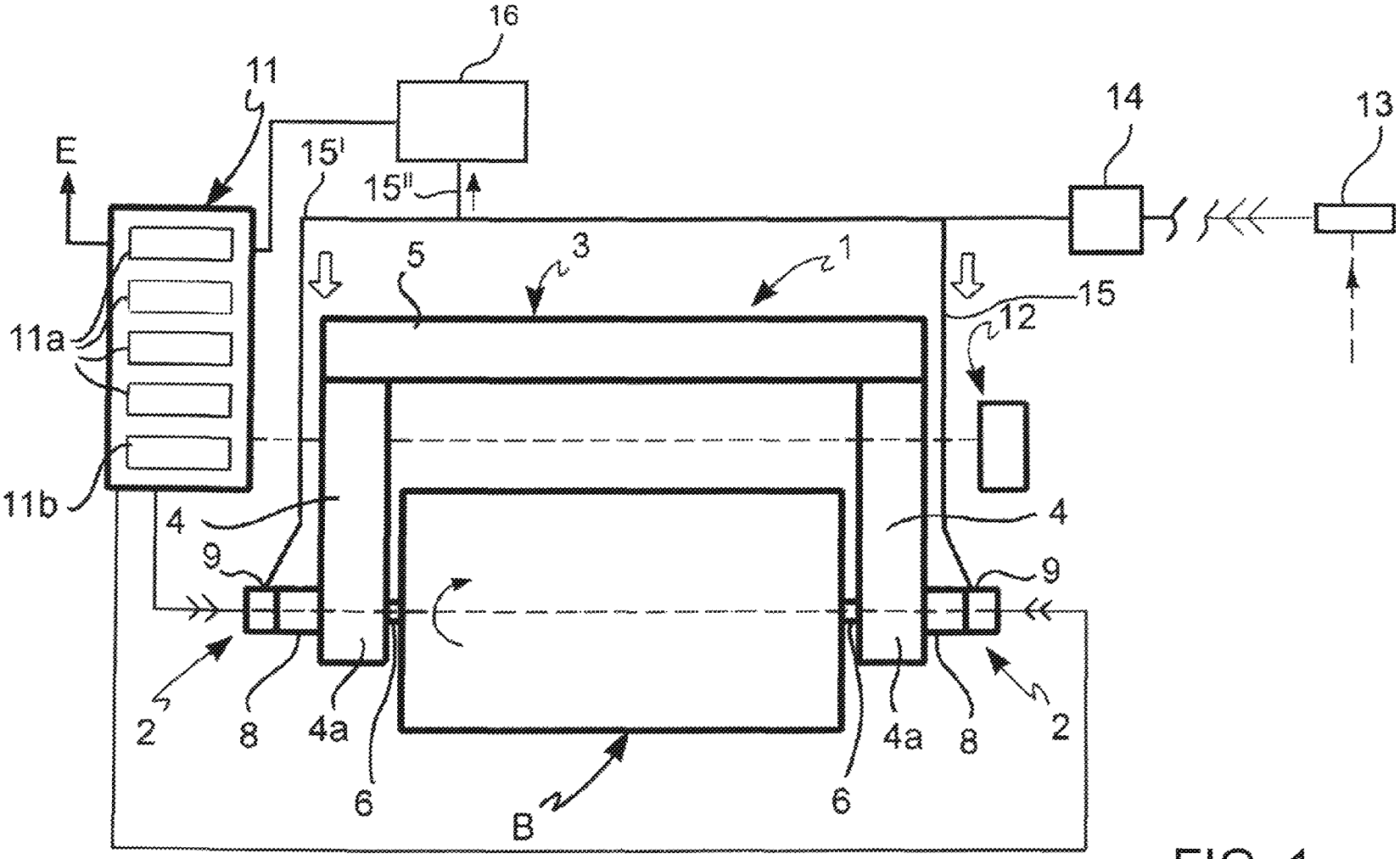
FIG. 1 PRIOR ART
FIG. 1 depicts a diagrammatic top view of the reel support member provided with a braking system according to the prior art.

FIG. 1 shows a support member 1 of a paper reel B on which a braking system 2 is installed as described below. Such a braking system is described, for example, in EP 3766813 A1 to the same Applicant.

The support member 1, in the example shown in the figures, is part of a machine (not shown) for producing cardboard, in particular for producing corrugated cardboard, which will comprise, downstream of the support member 1, a system for coupling several layers of paper and a pulling system for unwinding the paper from the reel B. The reel B, pulled to rotate by said pulling system during the production step, thus supplies a drive torque, which must be adjusted by the contrast with the braking system 2 so as to ensure the necessary tensioning of the paper for a correct unwinding thereof.

The support member 1, commonly referred to as a "roll-stand", comprises a C-shaped structure 3 having two arms 4 and a connection bar 5. The distal ends 4*a* of the arms 4 support respective shafts 6, which rotationally support the reel B at the two proximal ends 6*a* thereof. The braking system 2 is mounted instead at the distal ends 6*b* of the shafts 6, e.g. by keying.

Figure 2:
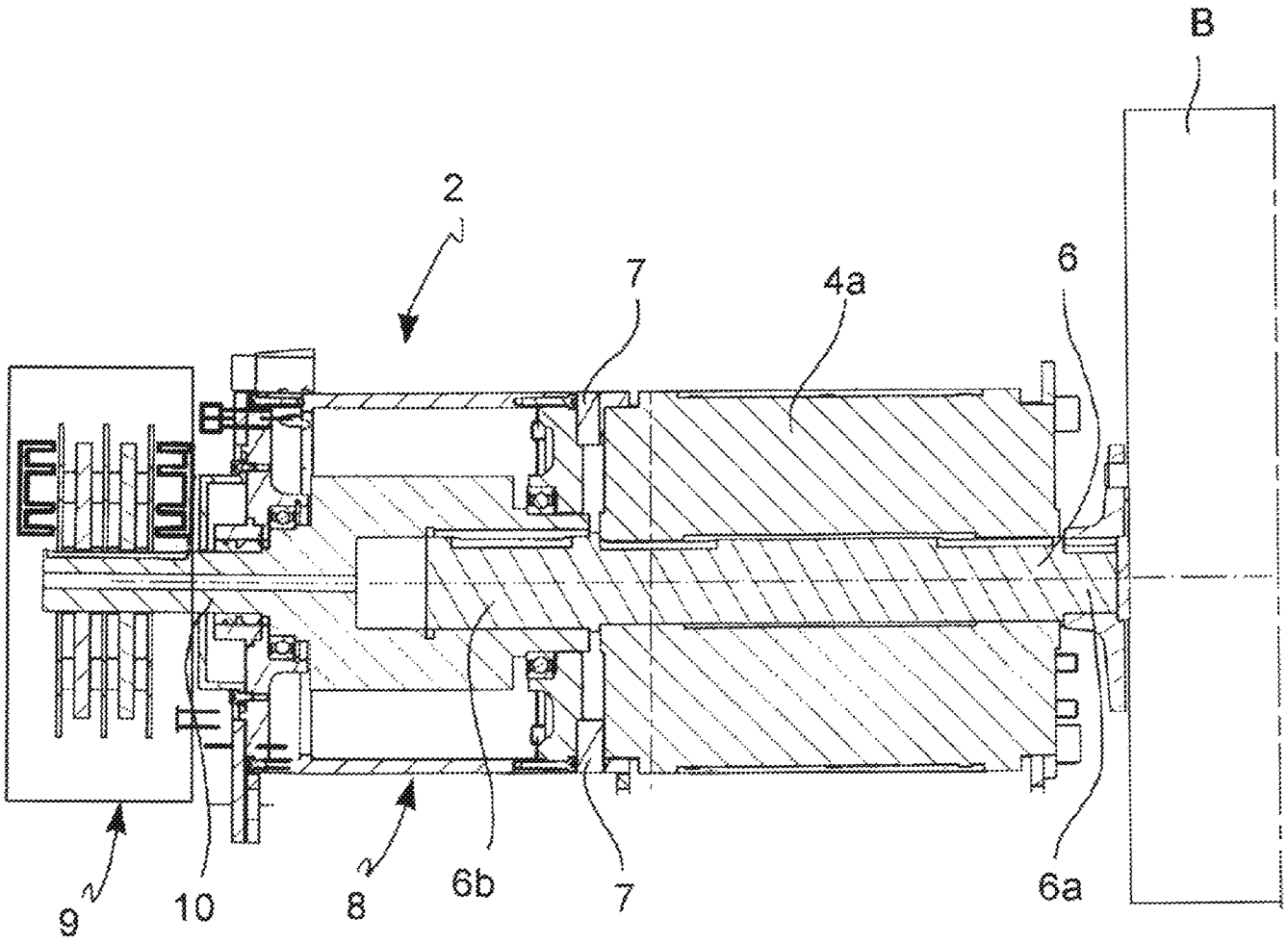
FIG. 2 PRIOR ART
FIG. 2 depicts a vertical section of a detail of the support member in FIG. 1 showing the braking system of the invention.

As shown in FIG. 2, the braking system 2 is coupled to the support member 1, for example, by a coupling flange 7.

The braking system 2 of the invention comprises a motor-generator device 8 and a mechanical brake device 9, arranged coaxially. Preferably, the mechanical brake device 9 is mounted and thus acts on the same shaft 10 as the motor-generator device 8.

The distal end 6*b* of the shaft 6 protrudes outwards from the distal end 4*a* of the respective arm 4 and is fastened coaxially inside the shaft 10 of the motor-generator device 8.

The motor-generator device 8 is an electric motor which, by the interface with an inverter, can supply, depending on the case (as it will be better described below), a drive torque or load torque producing, in the latter case, electricity.

The motor-generator device 8 is generally undersized with respect to the braking needs for unwinding the reel B, especially when the latter is at the start of the unwinding and therefore has a high inertial mass. This allows limiting the size and cost of the motor-generator device 8 with respect to known braking systems, which use only one motor braking system.

Preferably, the mechanical brake device 9 is a disk brake, with a single disk or multi-disk (a double disk is shown in the figure), of the pneumatic type.

For safety reasons, the mechanical brake device 9 is sized for a complete braking of the unwinding of the reel B, so as to intervene also in the case of emergency braking. However, in normal operating conditions, at the operating stages of start-up and stop, it is actuated by splitting the braking torque between it and the motor-generator device 8. A partial recovery of energy is thus obtained in the form of electricity, unlike the braking systems which use only one mechanical brake and in which all of the energy deriving from the friction is released into the atmosphere in the form of thermal energy. During the steady-state operation of the machine, however, only the motor-generation device works, thus maximizing the energy recovery.

As shown in FIG. 1, the braking system 2 according to the prior art comprises a command and control unit 11 and a user interface 12 for displaying the operating parameters.

Typically, a machine for producing cardboard comprises two support members 1 which act alternately and are designed to prevent a machine stop when a reel B is nearly finished and needs to be replaced with a new reel B. The arrangement of two support members 1 with the related reels B allows instead a quick joining of the ribbon of paper being processed with a new reel B when the reel B on the other support member 1 is almost finished.

Therefore, the method of producing cardboard comprises the following steps:

- start-up of the machine
- production step (steady-state step) at controlled speed and tensioning;
- replacement of an almost empty reel B with a new reel B.

As stated above, the motor-generator device 8 can act both as a motor, i.e., supplying a drive torque, and as a generator, i.e., supplying a braking torque. In particular, the motor-generator device 8 acts as a motor in the start-up step (referred to as the reel launch step), in conjunction with the pulling system so as to overcome the resistance due to the inertial mass of the reel B, and in the step of replacing the reel, so as to rewind the remaining ribbon of paper after the cutting and joining of the new reel B. Vice versa, the motor-generator device 8 acts as a generator during the normal production step of the machine.

Therefore, the command and control unit 11 is configured to command the operation of four braking systems 2, i.e., two braking systems 2 for each of the two support members 1, and for sending the electricity produced by the motor-generator device 8 to the power supply network E during the operational step.

FIG. 1 diagrammatically shows a braking system of the prior art, which is adapted to be integrated into cardboard producing machines already provided with a pneumatic type braking system. In such a system, known from EP 3766813 A1, for example, the tensile force of the line is detected in real time by a detection device 13, such as a jumper or a load cell.

The device 13 sends an electrical signal to an electro-pneumatic converter (EP converter) 14 integrated into the machine, which commands the pressure of the air, which is sent, along the lines 15, to the pneumatic mechanical brake devices 9, for generating the necessary braking torque to ensure the preset tension value. It should be noted that the configuration described thus far is typical of a roll-stand with a conventional pneumatic brake.

The system described in EP 3766813 A1 includes the arrangement of a derivation 15" of the pneumatic line 15, 15' operatively connected to a pressure transducer 16, which reads the air pressure along the line 15, 15' and translates it into an electrical signal which is sent to the command and control unit 11 which, by the herein below described algorithm, calculates the braking torque and sends a command signal to the motor-generator device 8.

The algorithm for calculating the splitting of the braking torque CL between the braking torque CM of the motor-generator device 8 and the braking torque CF of the mechanical brake device 9 is as follows:

a) when CL>CM−MAX, where CM−MAX is the maximum braking torque suppliable by the motor-generator device 8, CL is given by the sum CM−MAX+CF;

b) when CL<CM−MAX, CL is given by the sum of CM+CF, where CF=Mcl and CM=Ncl, where m=1−n and n is from 0.9 to 0.99 and is preferably about 0.95;

c) in the event of emergency braking, CL=CM−MAX+CF−MAX, where CF−MAX is the maximum braking torque suppliable by the mechanical brake device 9.

The total braking torque will thus be greater than that actually requested, whereby the detection device 13 will detect a greater tension than that requested and, as a result, the electro-pneumatic converter 14 will adjust the air pressure. A repetitive adjustment cycle is established, which allows achieving the equilibrium in fractions of a second, supplying the necessary braking torque CL split between CM and CF, as described above. However, this only occurs in machines in which the device 13 has quick response times, whereas if the reaction times thereof, as set, are slow, the previously described system is unusable.

Figure 3:
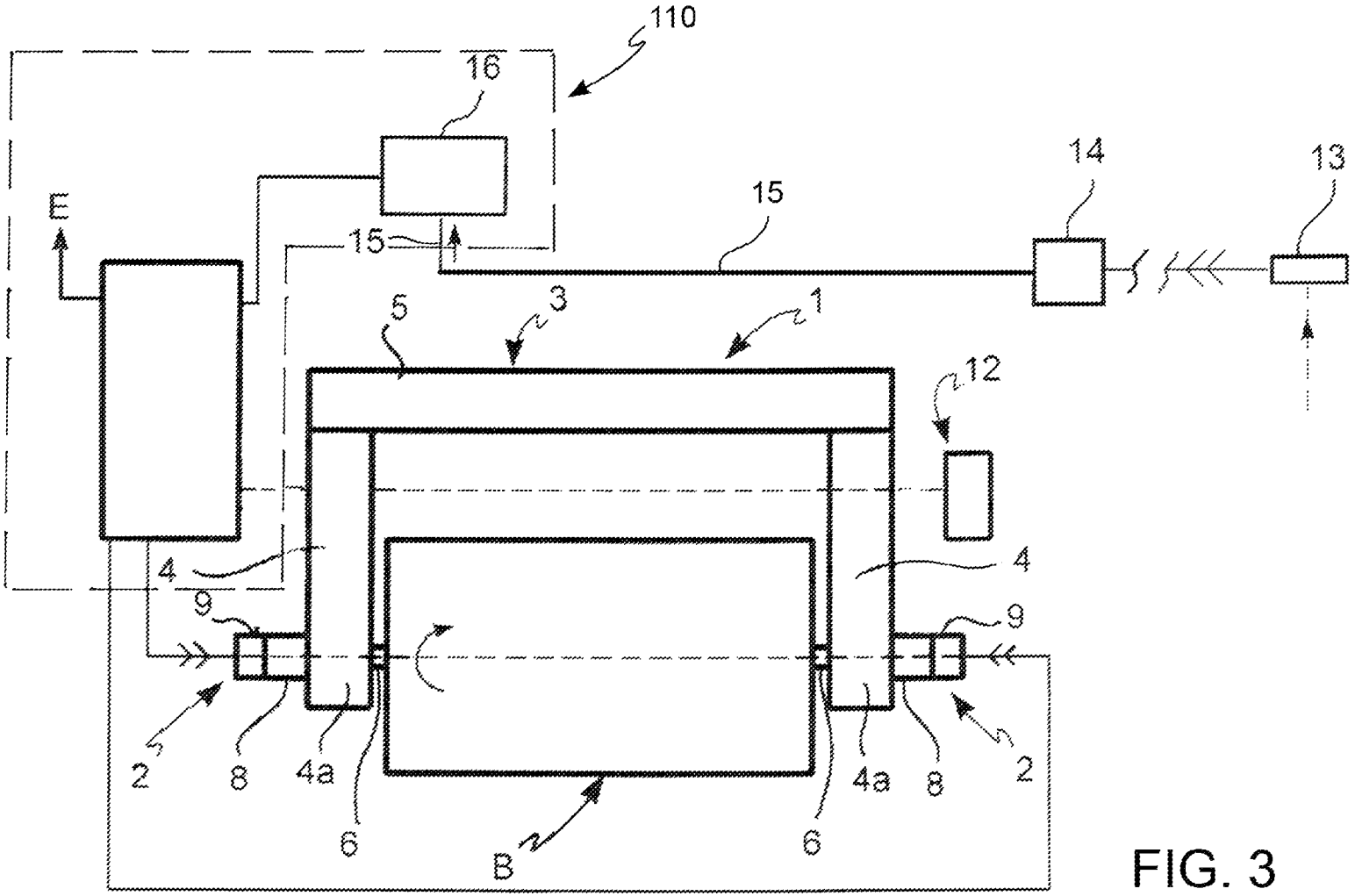
FIG. 3 depicts a block diagram of the braking control system according to the invention.
Figure 4:
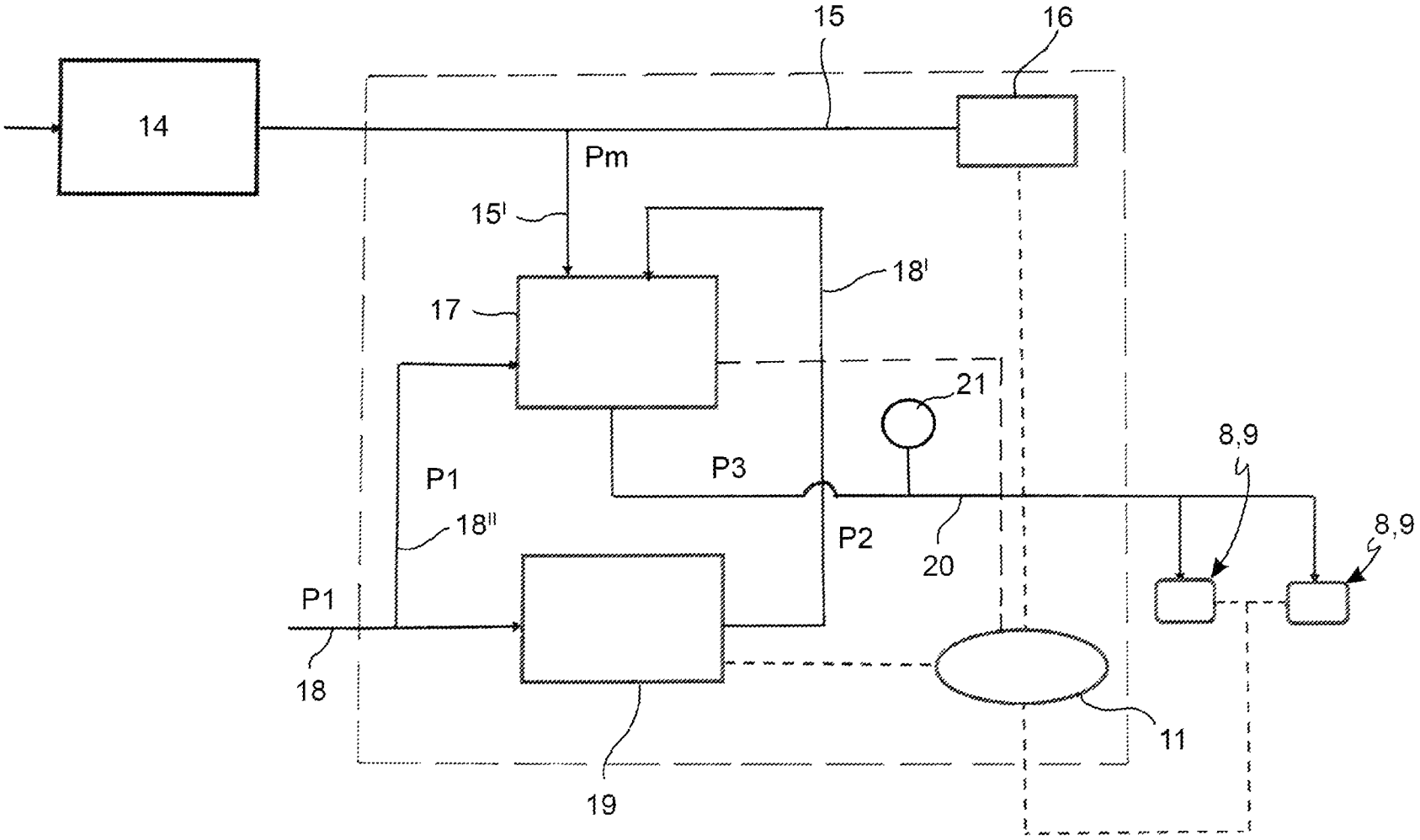
FIG. 4 depicts a block diagram of the braking control system according to the invention in a particular embodiment.

The upgrade braking control system of the present invention, indicated as a whole by reference numeral 110, is shown in general terms in FIG. 3 and more specifically in the diagram in FIG. 4. It tends to overcome the aforesaid problem of excessively long reaction times of device 13 replacing the braking control normally carried out by the electro-pneumatic converter 14 usually installed on the machine with a control completely carried out by the upgrade system 110 of the invention. Therefore, such a system is configured as a universal system to be applied as an upgrade to machines for producing cardboard, both whether they are provided with a combined brake having a motor-generator device 8 and a pneumatic mechanical brake 9, and whether they are only provided with a pneumatic mechanical brake 9. In the latter case, the system 110 of the invention will also comprise a braking system 2 having a motor-generator device 8 and a pneumatic mechanical brake device 9, which will replace only the pneumatic mechanical brake 9 of the original machine.

The term "upgrade system" means a system that can be implemented to an already operating machine to improve the braking control operated by the machine, by replacing this latter with the braking control provided by the upgrade system.

The tensile force of the line is detected, as said, in real time by a detection device 13, such as a jumper or a load cell, belonging to the machine and separate from the upgrade system of the invention.

The device 13 sends an electrical signal to an electro-pneumatic converter (EP converter) 14, also belonging to the machine and not to the upgrade system, which commands the pressure of the air sent along the line 15, at a pressure Pm. In a machine devoid of the system of the invention, the line 15 is directly connected to the pneumatic mechanical brake 9. Vice versa, when the system 110 is upgraded and integrated into the machine for producing cardboard, the air line 15 at the pressure Pm is intercepted by the system 110 of the invention. Both the device 13 and the electro-pneumatic converter 14 are integrated into the machine and therefore are not part of the braking control system 110.

In the system 110, the pressurized air line 15 is connected to a pressure transducer 16 integrated into the upgrade system of the invention and, by a derivation 15', to a solenoid valve 17. The pressure transducer 16 reads the pressure of the air along the line 15 and translates it into an electrical signal which is sent to the command and control unit 11 which, by an algorithm, calculates the splitting of the braking torque between the motor-generator device 8 and the mechanical brake 9.

The command and control unit 11 is operatively connected to the motor-generator device 8 and to an electro-pneumatic converter 19, integrated into the upgrade system 110. The electro-pneumatic converter 19 is pneumatically connected to an input line 18 for introducing air at a fixed pressure P1 (typically 6 bar) and to an output line 18' for releasing pressurized air, which sends pressurized air to the solenoid valve 17 at a varying pressure P2 calculated by the command and control unit 11 according to the splitting of the braking torque, as described below.

The pressurized air line 18 at the fixed pressure P1 comprises a pilot line 18", which is connected at the input to the solenoid valve 17 for supplying the necessary pilot pressure thereto. The pressure P1 is selected based on the pilot pressure requirements of the solenoid valve 17. In the case of using a solenoid valve, which is not pneumatically driven, the pilot line 18" will be omitted.

The solenoid valve 17 is a two-way valve and is pneumatically connected to a delivery line 20 which sends pressurized air at a braking pressure P3 to the mechanical brake device 9, where P3=Pm when the braking control system 110 is deactivated, i.e. the solenoid valve 17 puts the air lines 15' and into communication, or, when the system 110 is activated, P3=P2, wherein P2 is zero when the machine is operating at a steady-state, as will described below. The activation or deactivation command of the system 110 is provided by the command and control unit 11 upon selection by the operator, e.g., by the user interface 12. This allows putting alternatively the input line 18' coming from the electro-pneumatic converter 19 or the derivation 15' coming from the line 15 of the machine in communication with the delivery line 20 and thus excluding, if necessary, the system 110 of the invention, e.g., in the case of malfunctioning. When the system 110 is deactivated, only the mechanical braking device 9 will be operating, which is controlled by the pressure Pm supplied by the electro-pneumatic converter 14 of the machine. When the system 110 is activated, instead, the braking torque could be split between the mechanical brake device 9 and the motor-generator device 8 according to the calculation described below.

A pressure gauge 21 can be placed along the delivery line 20 for controlling the pressure P3 supplied.

In another embodiment, the solenoid valve 17 is replaced by a manual two-way valve. In this case, the pilot line 18" will be omitted.

Therefore, the braking control system 110 comprises:

a command and control unit 11;

a pressure transducer 16 configured to read the pressure Pm of the air along the line 15 coming from the machine for producing cardboard, which is indicative of the total torque CL required by the machine, and to translate it into an electrical signal which is sent to the command and control unit 11;

an electro-pneumatic converter 19 integrated into said system 110 and operatively connected to said command and control unit 11, said electro-pneumatic converter 19 being configured to adjust the pressure of the air at a delivery pressure P2 and being connected at the input to a line 18 for introducing air at a fixed pressure P1 which is greater than the delivery pressure P2, and at the output, to an output line 18';

a user interface 12 operatively connected to the command and control unit 11;

a solenoid valve 17 or a manual two-way valve pneumatically connected: i) at the input, to said output line 18' of the electro-pneumatic converter 19 and at a derivation 15' of the air line 15 to the pressure Pm coming from the machine for producing cardboard, and ii) at the output, to a delivery line 20 for delivering air at a pressure P3, where said delivery line 20 connects the solenoid valve 17 or the manual two-way valve to a mechanical brake device 9 and where said pressure P3 is equal to said pressure Pm when the system 110 is in the deactivated state or, when the system 110 is activated, P3=P2, wherein P2 is comprised between 0 and Pm;

where said command and control unit 11:

correlates the Pm value received from the pressure transducer 16 with a preset CL value which depends on the pneumatic brake installed on the machine;

receives the number of revolutions of the motor-generator device 8 and correlates it with a torque CM provided by the motor-generator device 8;

calculates the torque CF of the pneumatic brake device 9, commands the electro-pneumatic converter 19 to deliver a pressure P2 corresponding to the torque CF on the base of the calculation of a splitting of the preset braking torque CL to be supplied between a braking torque CF of the mechanical brake device 9 and a braking torque CM of the motor-generator device 8, wherein, when the torque CM of the motor-generator device 8 is equal or greater than CL, the torque CF of the pneumatic brake device 9 is zero.

In particular, P2 is different from zero only when the number of revolutions of the motor-generator device 8 is low, i.e. in the start-up and stop steps, while in the steady-state operation, when the torque CF is zero, P2=P3=0.

The command and control unit 11 is configured to calculating the splitting of the braking torque CL between the braking torque CM of the motor-generator device 8 and the braking torque CF of the mechanical brake device 9 according to the following algorithm:

a) when CL>CM−MAX, where CM−MAX is the maximum braking torque suppliable by the motor-generator device 8, CL is given by the sum CM−MAX+CF;

b) when CL≤CM−MAX, CL=CM;

c) in the case of emergency braking, CL=CM−MAX+CF−MAX, where CF−MAX is the maximum braking torque suppliable by the mechanical brake device 9.

By an interface with an inverter, the electricity produced by the motor-generator device 8 is sent to the power supply network (E).

In the previous description, reference has been made to a braking system comprising a motor-generator device 8 and a mechanical brake device 9 arranged coaxially on the same transmission shaft.

Figure 5:
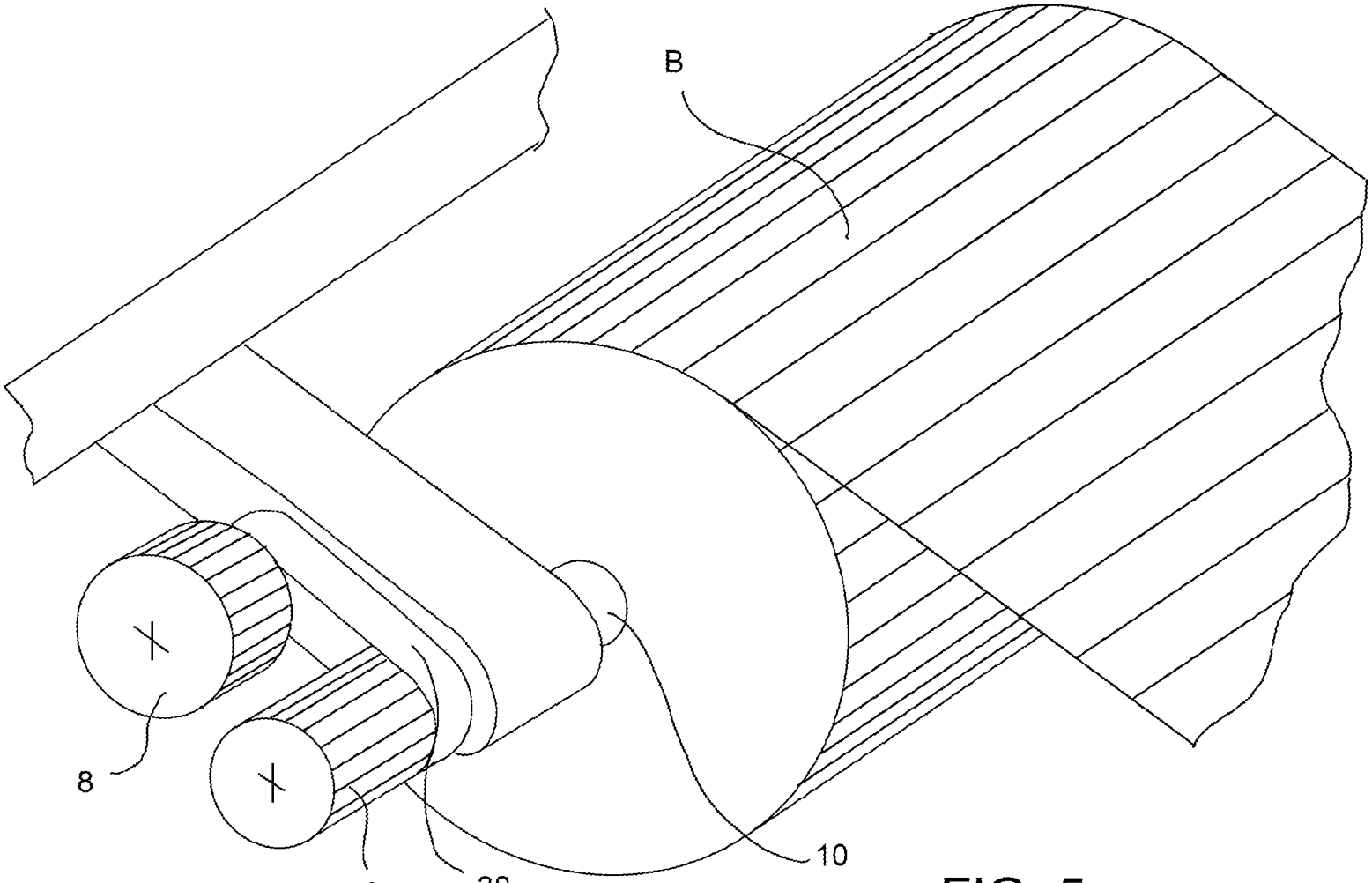
FIG. 5 represents a perspective view of a detail of the support member of a reel according to a different embodiment of the invention.

However, as shown in FIG. 5, the braking control system 110 of the invention can equally be applied to a braking system in which the motor-generator device 8 and the mechanical brake device 9 are not placed on the same axis, but they are, for example, side by side.

FIG. 5 shows a reel B whose shaft is associated with a mechanical brake device 9 of the pneumatic type. The motor-generator device 8, on the other hand, is placed side by side and is operatively associated with the shaft of the reel B by a transmission member 30, for example a belt or a chain or, in an embodiment not shown, by gears, a reducer or a multiplier.

Therefore, the braking control system 110 of the invention achieves the predetermined objects.

In fact, such a system can also be integrated into machines for producing cardboard already in use and having a braking system comprising both a motor-generator brake and a pneumatic brake, simply by connecting, at the input, the pressurized air line at the pressure Pm of the machine to the system 110 of the invention and the latter, at the output, to the machine braking system.

If the machine for producing cardboard is only provided with a pneumatic brake or an electric motor brake, instead, the system 110 of the invention will also include a braking system 2 as described above, which will replace the original pneumatic brake.

The braking control system 110 of the invention is unexpensive and has small dimensions due to the fact that the contemporary use of a mechanical brake does not require a high power motor-generator.

The braking system 2 further allows a recovery of electricity, although only partial (i.e., relating only to the braking torque part supplied by the motor generator device 9).

It is apparent that only some particular embodiments of the present invention have been described, to which those skilled in the art will be able to make all changes required for the adaptation thereof to particular applications, without departing from the scope of protection of the present invention.

The invention claimed is:

1. An upgrade braking control system for a machine for producing cardboard or corrugated cardboard, having, or in which at least one braking system has been installed, comprising a motor-generator device and a pneumatic mechanical brake device, said system comprising:

a command and control unit;

a pressure transducer configured to read a pressure Pm of air along a line coming from the machine for producing cardboard, the pressure being indicative of total torque CL required by the machine, and to translate the total torque CL into an electrical signal to be sent to the command and control unit;

an electro-pneumatic converter integrated into said upgrade braking control system and operatively connected to said command and control unit, the electro-pneumatic converter of the upgrade braking control system being configured to adjust pressure of the air at a delivery pressure P2 and being connected at the input to an air line at a fixed pressure P1, which is greater than the delivery pressure P2, and, at the output, to an output line;

a user interface operatively connected to the command and control unit;

a solenoid valve or a manual two-way valve pneumatically connected: i) at the input, to said output line of the electro-pneumatic converter and at a derivation of the air line to the pressure Pm coming from the machine for producing cardboard, and ii) at the output, to a delivery line for delivering air at a braking pressure P3, wherein said delivery line connects the solenoid valve or the manual two-way valve to a mechanical brake device, and wherein said pressure P3 is equal to said pressure Pm when the system is in the deactivated state, or when the system is activated, P3=P2, wherein P2 comprises between 0 and Pm;

wherein said command and control unit:

correlates the Pm value received from the pressure transducer with a preset CL value which depends on the pneumatic brake installed on the machine;

receives a number of revolutions of the motor-generator device and correlates the number of revolutions with a torque CM provided by the motor-generator device;

calculates the torque CF of the pneumatic brake device;

commands the electro-pneumatic converter to deliver a pressure P2 corresponding to the torque CF based on calculation of a splitting of the preset braking torque CL to be supplied between a braking torque CF of the mechanical brake device and a braking torque CM of the motor-generator device, wherein, when the torque CM of the motor-generator device is equal or greater than CL, the torque CF of the pneumatic brake device is zero.

2. The system according to claim 1, wherein the command and control unit is configured to calculate the splitting of the braking torque CL between the braking torque CM of the motor-generator device and the braking torque CF of the mechanical brake device according to the following algorithm:

a) when CL>CM−MAX, where CM−MAX is the maximum braking torque suppliable by the motor-generator device, CL is given by the sum CM−MAX+CF;

b) when CL≤CM−MAX, CL=CM;

c) for emergency braking, CL=CM−MAX+CF−MAX, where CF−MAX is a maximum braking torque suppliable by the mechanical brake device.

3. The system according to claim 1, wherein said air line at the fixed pressure P1 is connected by a pilot line to said solenoid valve or manual two-way valve for piloting said solenoid valve.

4. The system according to claim 1, wherein said delivery line comprises a pressure gauge.

5. The system according to claim 1, wherein said braking system is configured for replacement of an originally mounted pneumatic mechanical brake or an electric motor brake.

6. The system according to claim 5, wherein the mechanical brake device is mounted to a same shaft as the motor-generator device.

7. The system according to claim 5, wherein the mechanical brake device and the motor-generator device are not mounted on the same shaft and are kinematically connected by a transmission member.

8. The system according to claim 1, wherein the motor-generator device is an electric motor, which is configured, by an interface with an inverter, to supply a drive torque or a load torque, producing, for a load torque, electricity.

9. The system according to claim 1, wherein the mechanical brake device is a pneumatic mono-disk brake or a pneumatic multi-disk brake.

10. The machine for producing cardboard or corrugated cardboard, for either printing or converting, comprising one or more support members of a reel of paper or other material, wherein each of said support members comprises a C-shaped structure having two arms and a connection bar, wherein distal ends of the arms support respective shafts, which rotationally support the reel at two proximal ends thereof, a braking system comprising the motor-generator device and the pneumatic mechanical brake comprising the braking control system according to claim 1, being mounted at the distal ends of the shafts.

11. The machine for producing cardboard or corrugated cardboard, for either printing or converting, comprising two support members of a reel of paper or other material, wherein each of said support members comprises a C-shaped structure having two arms and a connection bar, wherein distal ends of the arms support respective shafts, which rotationally support the reel at two proximal ends thereof, a braking system comprising the motor-generator device and the pneumatic mechanical brake comprising the braking control system according to claim 1, being mounted at the distal ends of the shafts.

* * * * *